United States Patent [19]

House

[11] Patent Number: 4,631,019

[45] Date of Patent: Dec. 23, 1986

[54] COMBINATION APPLICATOR AND SHAPER FOR MOLDABLE MATERIALS

[76] Inventor: Bruce F. House, 2249 E. Goldpearl La., Hernando, Fla. 32642

[21] Appl. No.: 794,840

[22] Filed: Nov. 4, 1985

[51] Int. Cl.[4] ..... B05C 17/10

[52] U.S. Cl. ..... 425/458; 15/104 S; 15/145; 15/235.8

[58] Field of Search ..... 425/458; 15/104 S, 145, 15/235.8, 235.6, 235.7, 235.4, 235.5

[56] References Cited

U.S. PATENT DOCUMENTS

| | | | |
|---|---|---|---|
| 952,971 | 3/1910 | Wolary et al. | 15/235.8 |
| 1,067,301 | 7/1913 | Bricker | 15/235.8 |
| 1,083,099 | 12/1913 | Howg | 15/235.8 |
| 2,432,792 | 12/1947 | Ovenshire | 15/145 |
| 2,824,330 | 2/1958 | Williams | 15/104 S |
| 2,947,017 | 8/1960 | Dybdahl | 15/235.8 |
| 2,968,057 | 1/1961 | Pratt | 15/104 S |
| 3,341,878 | 9/1967 | Hubbard | 15/235.4 |
| 4,097,951 | 7/1978 | Hurtt | 15/104 S |
| 4,307,481 | 12/1981 | Phares | 15/104 S |

*Primary Examiner*—Tim Miles

*Attorney, Agent, or Firm*—Ernest H. Schmidt

[57] ABSTRACT

A flat, quadrilateral, resilient spreader member, symmetrical about its longitudinal axis and having mutually convergent, longitudinal edges, has handle members removably attachable along its longitudinal edges for bending the spreader member while being used in the application and shaping of moldable material to a workpiece.

6 Claims, 8 Drawing Figures

COMBINATION APPLICATOR AND SHAPER FOR MOLDABLE MATERIALS

This invention relates to hand-held tools for the application and shaping of moldable materials, and is directed particularly to improvements in such tools for the spreading and contouring or shaping of filler materials in auto body repair work.

In auto body repair work it is common practice to hammer, pull and otherwise reshape damaged sheet metal areas to the approximate original shape and then achieve substantially original contour by the smooth spreading on of a moldable, self-curing resin that hardens within one or two minutes. Heretofore, spatulas of one kind or another, or flat cards or shapes of flexible sheet metal or synthetic plastic were used to apply and shape such filler materials. Because of the very short time period that the filler material, after its preparation for use, remains plastic and spreadable, great dexterity was necessary to achieve the necessary contour shaping and smoothness before hardening set in. The reshaping of sharply defined concavities and convexities was particularly difficult with the conventional tools for this purpose. Imperfections remaining in the hardened filler material in such areas usually required heavy sanding to achieve a satisfactory smoothness for finish painting.

It is, accordingly, the principal object of this invention to provide a novel and improved combination applicator and shaper for moldable materials such as body repair fillers that is hand adjustable for smooth application of material more or less precisely to the original contour of the surface being repaired, whether flat, slightly curved or arcutely concave or convex.

Another object of invention is to provide an applicator and shaper of the character described that combines an applicator-shaper member with readily changeable handles quickly adapting for use in shaping concavities, convexities or substantially flat surface areas, as may be required.

Another object of the invention is to provide a combination applicator and shaper wherein the applicator portion is in the form of a flat, resilient spreader member which, prior to being bent for shaping, serves as a mixing surface for the filler material to be applied and molded into shape.

Another object is to provide a combination applicator-shaper of the above nature which will be simple in construction, inexpensive to manufacture, economical in cost, and so effective in use that precise application and shaping of moldable material can readily be achieved by an operator even with minimal prior experience.

Other objects, features and advantages of the invention will be apparent from the following description when read with reference to the accompanying drawings.

BRIEF DESCRIPTION OF THE DRAWINGS

In the drawings, wherein like reference numerals denote corresponding parts throughout the several views.

Figure 1:
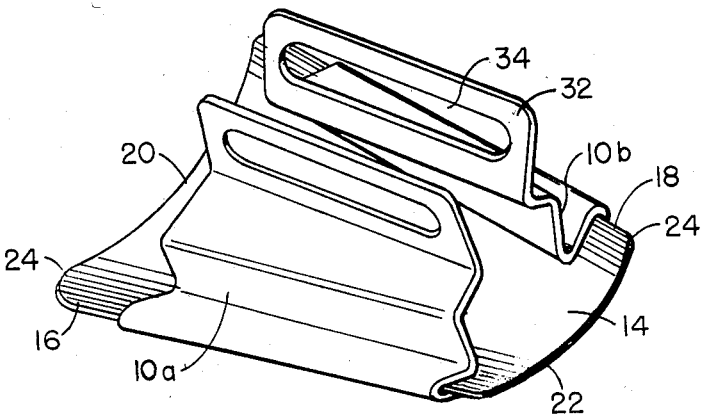
FIG. 1 is an oblique view, as seen from above, of an applicator embodying the invention, adjustable for the smooth shaping of filler material in concave areas.

Referring now in detail to the drawings, reference numeral 10 designates, generally, in FIGS. 1, 3, 5, and 5*a* the applicator and shaper embodying the invention equipped with handles that can be manipulated for the spreading on of filler material or the like in rounded depressions or concavities, and reference numeral 12 in FIGS. 2, 4, 4*a* and 6 designates, generally, the applicator and shaper embodying the invention equipped with handles that can be manipulated for the spreading on of filler material or the like in rounded protrusions or convexities.

Figure 2:
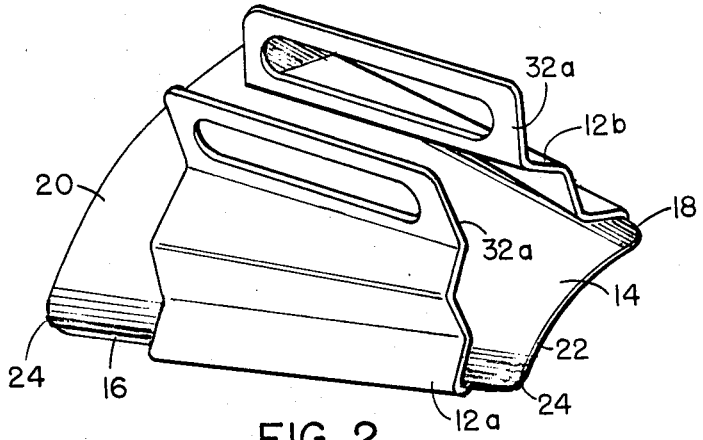
FIG. 2 is an oblique view, as seen from above, of an applicator embodying the invention, adjustable for the smooth shaping of filler material in convex areas.

The embodiments of the invention illustrated in FIGS. 1 and 2 differ only in that the removeable handle pair 10*a* and 10*b* of FIG. 1 differ from the handle pair 12*a* and 12*b* of FIG. 2 in the relative angles at which they extend upon being attached to opposite edges of the flexible spreader member 14, said spreader member being the same in each embodiment.

The spreader member 14, which will preferably be fabricated of a high lubricity synthetic plastic material, is slightly elongated and symmetrical about its longitudinal axis. The shape is such that the longitudinal edges 16, 18 converge to define relatively long and short end edges 20, 22, respectively. The four corners of the regular trapezoidal spreader member shape as so defined are rounded, as indicated at 24.

Figure 3:
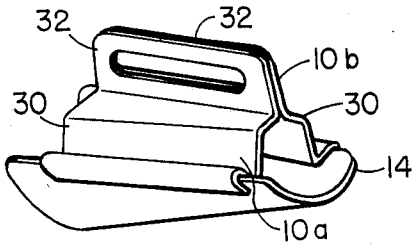
FIG. 3 is an oblique view similar to that of FIG. 1 showing the handles pressed fully together for use in shaping small radius concavities.

Referring to FIGS. 1, 3, 5 and 5*a*, handle members 10*a*, 10*b* will preferably be fabricated by bending of strong sheet-metal, such as stainless steel. Each member comprises a double-bent base portion 26 defining a bight 28 having a longitudinal slot within which a marginal longitudinal edge portion 16 or 18 of the flexible spreader member 14 can be manually inserted for frictional retention in place, (see FIG. 5*a*). The double-bent base portion 26 extends into an integrally formed, central, accordion-bent portion 30 terminating in a substantially rectangular, flat, elongated handle portion 32. As illustrated in FIG. 3, the bending contour of the central accordion-bent portion 30 is such that when the handle member pair 10*a* and 10*b* are assembled to a flexible spreader member 14 and handle portions 32 are manually pressed together so that the spreader member 14 is thereby bent outwardly to maximum curvature, said handle portions will be moved into face-to-face abutting relationship. To facilitate non-slip finger-grip relative movement of the handle portions 32, they are provided with longitudinally-extending through slots or openings 34.

Figure 4:
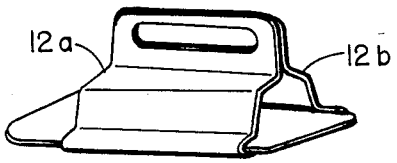
FIG. 4 is an oblique view similar to that of FIG. 2 but showing the convexity handles in their normal resting or spread position for shaping flat surfaces.

Referring to FIGS. 2, 4, 4*a* and 6, the handle members 12*a* and 12*b* differ from the handle members 10*a*, 10*b* described above only in that the bending contour of the central accordion-bent portion 30*a* is such that when a handle pair 12*a*, 12*b* is assembled to a flexible spreader member 14, the handle portions 32*a* will be in substantially face-to-face abutting relation (see FIG. 4).

In use, as described above, a handle member pair 10*a*, 10*b*, as illustrated in FIGS. 1 and 3 for example, will be used for spreading moldable materials for concavity shaping, whereas, as illustrated in FIGS. 2 and 4, handle members 12*a*, 12*b* will be used for spreading moldable materials for convexity shaping. The radius of concavity or convexity shaping with use of the tool, it will be understood, is controlled by manual adjustment of the spacing between the handle portions 32, or 32*a* of the handle members being used. In this connection it will be noted that the handle member design in each instance of usage is such that the spreader member 14 is bent to a smaller radius at the short edge 22 than at the long edge 20 of the flexible spreader member 14. This provides for a wider range of arcuate shape of spreader edges, thereby enhancing the versatility of usage in the filler shaping of a wide range of work member concavities and convexities.

Figure 5:
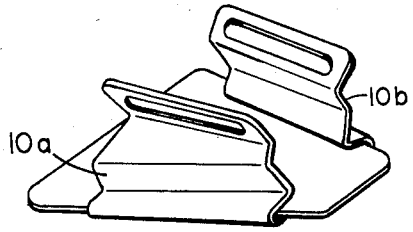
FIG. 5 is an oblique view similar to that of FIG. 1 but on a smaller scale showing how the concavity handles spread open in rest position.
Figure 6:
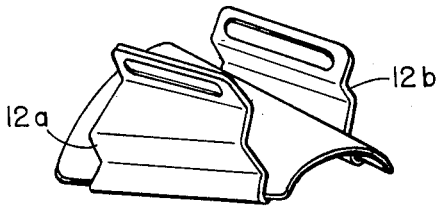
FIG. 6 is a view similar to that of FIG. 4 but showing the convexity handles spread apart for the spreading and shaping of filler material over small radius convexity areas.
Figure 4A:
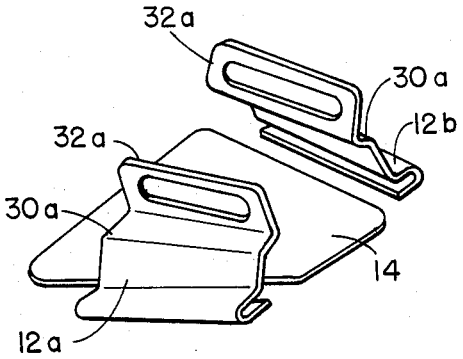
FIG. 4*a* is a view similar to that of FIG. 4, but showing the parts in "exploded" relation.
Figure 5A:
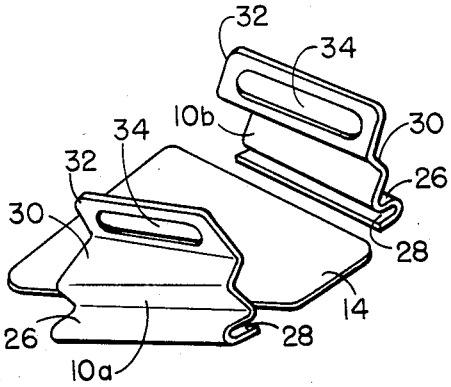
FIG. 5*a* is a view similar to that of FIG. 5, but showing the parts in "exploded" relation.

As will be readily apparent from the illustrations of FIGS. 4 and 5, the outside surface of the flexible spreader member 14, normally being flat, can be used as a mixing surface for self-curing resins of the type used, for example, in auto body repair work.

In use, although I have described my invention as constituting different pairs of handle members for specific use, respectively, in shaping convexities and concavities, the embodiment of FIGS. 1, 3, 5 and 5*a*, with normally wide-spread handle portions can be manipulated with the use of two hands to flex the spreader member between concave and convex shapes to allow for spreading and shaping along surface areas which gradually merge between concave and convex. It is also to be noted that while I have particularly described my invention for use in auto body repair work, it is also well adaptable to use in applying and/or shaping moldable materials to sculptures, cement forms and and like. The invention, in brief, comprises all the embodiments and modifications coming within the scope and spirit of the following claims:

What I claim as new and desire to secure by Letters Patent is:

1. A combination applicator and shaper for moldable materials comprising, in combination, a flat, resilient spreader member, said spreader member defining a regular trapezoid in peripheral shape having the axis of symmetry about its longitudinal axis, and a pair of handle members removably attachable along the mutually convergent marginal longitudinal edge portions of said spreader member to facilitate manual bending of said spreader member about its axis of symmetry.

2. A combination applicator and shaper as defined in claim 1, wherein said handle members are fabricated of a comparatively rigid material and normally extend outwardly of one side of said spreader member.

3. A combination applicator and shaper as defined in claim 2, wherein said handle members are each fabricated of bent sheet metal, and wherein said removeable attachment means comprises a double-bent base portion defining a bight, said bight providing a longitudinal slot within which said marginal longitudinal edge portions of said flexible spreader member can be manually inserted for frictional retention in place.

4. A combination applicator and shaper as defined in claim 3, wherein each of said handle members comprises a central, accordian-bent portion integrally formed with said base portion, said accordian-bent portion terminating in a substantially rectangular, flat handle portion.

5. A combination applicator and shaper as defined in claim 4, wherein the bending contour of said central accordian-bent portion is such that when the handle members are assembled to said flexible spreader member and said handle portions are manually pressed together so that said spreader member is flexed outwardly to maximum curvature, said handle portions will be moved into face-to-face abutting relationship.

6. A combination applicator and shaper as defined in claim 4, wherein the bending contour of said accordian-bent portion is such that when the handle members are assembled to said flexible spreader member, said handle portions will normally be disposed in substantially face-to-face abutting relationship.

* * * * *